United States Patent [19]

Neilsen

[11] Patent Number: 4,662,199

[45] **Date of Patent: * May 5, 1987**

[54] KEY RETAINING DEVICE

[76] Inventor: Hildaur L. Neilsen, 2 Juniper St., Metuchen, N.J. 08840

[ * ] Notice: The portion of the term of this patent subsequent to Feb. 18, 2003 has been disclaimed.

[21] Appl. No.: 744,794

[22] Filed: Jun. 13, 1985

Related U.S. Application Data

[63] Continuation-in-part of Ser. No. 484,976, Apr. 14, 1983, Pat. No. 4,570,469, which is a continuation-in-part of Ser. No. 345,722, Feb. 4, 1982, Pat. No. 4,448,051, and Ser. No. 322,265, Nov. 17, 1981, Pat. No. 4,441,348.

[51] Int. Cl.[4] ..... E05B 11/00; E05B 73/00

[52] U.S. Cl. ..... 70/389; 70/19

[58] Field of Search ..... 70/389, 19, 63, 64, 70/456 R; 194/65, 51, 59

[56] References Cited

U.S. PATENT DOCUMENTS

| | | | |
|---|---|---|---|
| 704,655 | 7/1902 | Morgan | 70/453 |
| 4,090,380 | 5/1978 | Bianco | 70/19 |
| 4,570,469 | 2/1986 | Neilsen | 70/389 |

*Primary Examiner*—Robert L. Wolfe
*Attorney, Agent, or Firm*—Stefan J. Klauber

[57] ABSTRACT

A key retaining device for capturing and selectively locking therein a portion of the working section of a key. When the key is locked in the device, its handle section is visible so that the presence of the key can be instantly determined without the unlocking of the apparatus, yet the key cannot be removed from the device until unlocked with a master key. Retention of the key within the housing is accomplished by a clamping mechanism employing a longitudinally sliding member having a wedge-like member which is urged toward the working section of the key upon the sliding member moving in a first longitudinal direction. The sliding member is moved by a bolt couled to a lock by a master key and which is rotated by the master key, and a nut which is held in a transverse slot of the slideable member. The master key when rotated in a second direction unthreads the bolt to which it is coupled from the nut, moving the sliding member in the opposite longitudinal direction to release the wedge-like member which holds the key.

9 Claims, 4 Drawing Figures

FIG. 3
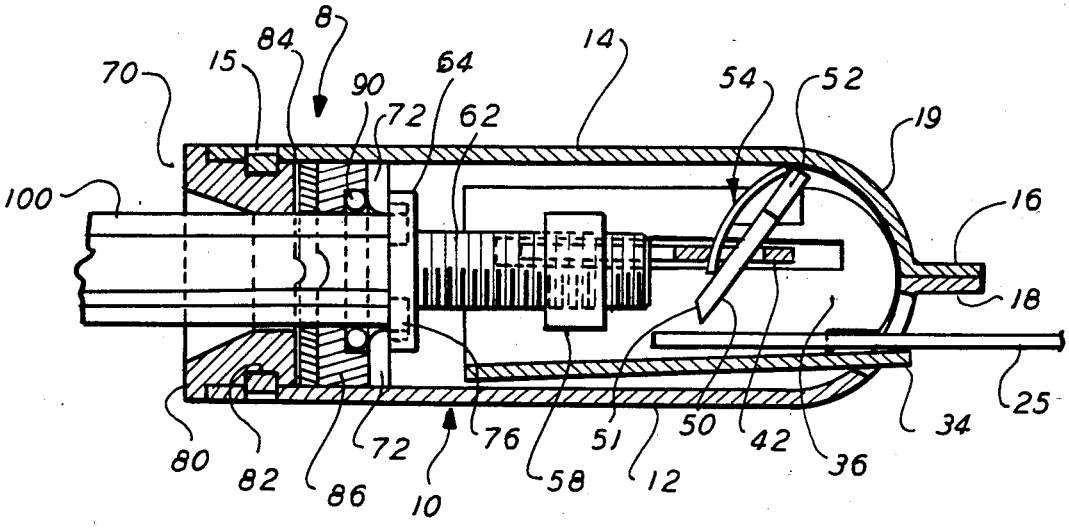
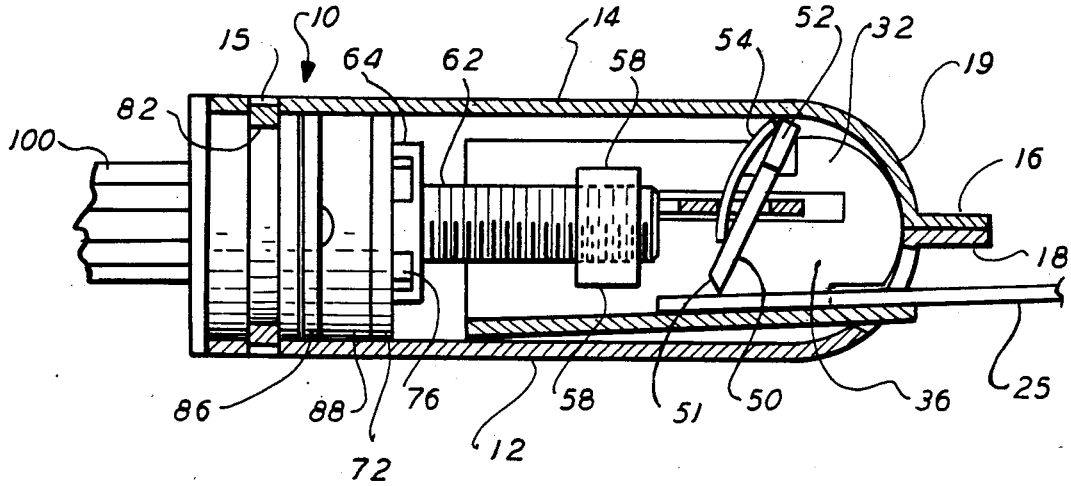
FIG. 4

KEY RETAINING DEVICE

FIELD OF THE INVENTION

This application is a continuation-in-part of my copending application Ser. No. 484,976, filed Apr. 14, 1983, and now U.S. Pat. No. 4,570,469 which was a continuation-in-part of application Ser. No. 345,722, filed Feb. 4, 1982, now U.S. Pat. No. 4,448,051, and application Ser. No. 322,265 filed Nov. 17, 1981, now U.S. Pat. No. 4,441,348.

This invention relates generally to systems for safeguarding keys from unauthorized use, and more specifically, relates to a key retaining device which permits a key to be prominently displayed, yet totally unavailable for use, unless released by authorized means.

BACKGROUND OF THE INVENTION

There are many instances when it is desirable to leave a key proximate to the lock which it locks, yet to place the key in a circumstance such that it cannot be used by unauthorized personnel. An especially pertinent example arises in connection with automobile parking lots. Especially in lots with very large capacities, the tagging of ignition keys and their removal from the associated vehicle is not only time consuming, but also presents a substantial logistic and clerical task. The ideal situation would be one where the parking lot attendants are able to leave keys within the vehicle, yet at the same time placing the keys in a condition such that they cannot be employed by unauthorized personnel.

Typical of further environments where such need arises is the practice of real estate brokers leaving keys on the doors of houses which are for rent or sale in a locked box wherein a key is placed totally inside the box. In this situation, an authorized real estate broker can unlock the box and gain access to the key through the use of a master key so that the locked key can be used to open a door.

Various attempts have been made in the prior art to provide various apparatus which will be satisfactory for use in the above-described situations. Typical of these prior art apparatus are those disclosed in U.S. Pat. Nos. 3,636,742 issued to G. B. Ranay on Jan. 25, 1972; 3,695,067 issued to R. D. Bays on Oct. 3, 1972; 3,712,091 issued to R. J. Parent on Jan. 23, 1973; 3,742,741 issued to L. L. Cahan on July 3, 1973; and 3,744,281 issued to R. F. Logue et al on July 10, 1973. Each of these apparatus provide a means for suspending a locked box from a suitable supporting surface and means for placing a key totally inside the locked box such that the locked box can be locked by a master key and access to the locked key can be precluded. The locked boxes are openable with a master key presumably only available to authorized personnel.

Unfortunately, all of the above apparatus suffer from at least two shortcomings. First of all, it is not known whether or not a key is disposed inside one of these locked boxes unless the locked box is actually opened. This is more than an inconvenience since considerable time can be lost in determining whether or not a key is available as a result of having to open a plurality of boxes. A second shortcoming is that any of these devices can be battered or broken open without any substantial risk of damaging the key disposed therein. As a result, unauthorized personnel can essentially strong arm the locked boxes open and be presented with a perfectly usable key to the total frustration of the intended purpose of these devices.

In U.S. Pat. No. 4,090,380 to Bianco there is disclosed another device which has recently come into use in parking lots which utilizes a cylindrical body having a transverse slot into which the working portion of an ignition key may be inserted. Jaws above and below the slot are then clamped against the key portion by advancing one of the jaws axially in the body. This is effected by means of a specially shaped wrench which engages a member threadingly received into the cylinder. Such member in turn drives the one jaw toward the opposed jaw and intervening key. While this type of device has received a degree of acceptance, it suffers from the serious deficiency that a make-shift tool may be readily used to substitute for the aforementioned wrench, thereby circumventing the safeguard presumably provided by the device.

While safeguards can be provided with protective key-retaining devices which can only be opened by authorized personnel having keys, either individual or masters which are specially made for the locks used with the device, it would be particularly advantageous if such keys, and particularly those which serve as a master capable of unlocking a large number of such devices, could not itself be readily duplicated in an unauthorized manner. It is known that locks generally commercially available use keys which can be readily duplicated from standard blanks. Thus, the use of a nonstandard lock which is simple in construction, yet sturdy enough to be effective, would be a highly desirable adjunct to any protective key-retaining device.

Heretofore, a variety of different locks which require special keys have been suggested such as, for example, disclosed in U.S. Pat. No. 208,863 to Taylor, U.S. Pat. No. 704,655 to Morgan, U.S. Pat. No. 1,100,412 to Pantazi and U.S. Pat. No. 1,300,983 to Luckey. However, none of these locks disclose apparatus such as a protective key-retaining device or suggest features of construction that would be applicable for such use.

SUMMARY OF THE INVENTION

The present invention overcomes the problems and shortcomings associated with the prior art by providing a key retaining device which does not entirely enclose the retained key and which therefore permits visual inspection of the handle section of the key so that an observer instantly knows whether or not a key is engaged in the device. The present invention also totally destroys the usability of a key clamped therein if unauthorized extraction of the key is attempted in the apparently most logical manner, i.e., by grasping of the exposed handle section thereof and pulling on same to try to remove the key. Further, the present invention assures that only an individual in possession of the authorized means of release will be able to operate the device so as to gain access to a retained key.

In accordance with the foregoing, it may be regarded as an object of the present invention to provide a key retaining device which will retain and lock a key in a position such that it is unusable unless removed by authorized personnel.

A further object of the present invention is to provide a key retaining device which captures and selectively locks therein only the working section of an inserted key, leaving the handle section thereof visible.

A still further object of the present invention is to provide a key retaining device, which upon inspection by an interested party will reveal whether or not a key is present without unlocking of the device.

Still another object of the present invention is to provide a key retaining device which, if unauthorized withdrawal of a key therefrom is attempted, will tend to result in rendering the key inoperative.

Another object of the present invention is to provide a key retaining device for capturing and selectively locking therein a variety of differently shaped and configured keys.

Yet another object of the present invention is to provide a key retaining device for capturing and selectively locking therein a key, which is suitable for manufacture in as many units as desired, each being openable by a master key.

Yet still another object of the present invention is to provide a key restraining device for capturing and selectively locking therein a variety of differently shaped and configured keys, which may be inexpensively manufactured in as many units as desired, each being openable by a master key having unique features which are unlikely to be duplicated by unauthorized personnel.

A still additional and further object of the present invention is to provide a key retaining device which is simple in design, relatively inexpensive to manufacture, rugged in construction, durable, easy to operate, and efficient in operation.

Now in accordance with the present invention, the foregoing objects, as well as further objects as will become apparent in the course of the ensuing specification, are achieved in a key retaining device which interacts with a key so as to capture and selectively lock therein a portion of the working section of a key having a working section and a handle section. In accordance with the present invention, a device is provided which comprises housing means forming a chamber therein, a slot being disposed through a wall of said housing means which is in communication with the chamber and being dimensioned to accommodate therethrough a portion of the working section of the key for insertion into the chamber, and means for selectively and releasably securing the portion of the working section of the key when inserted into the chamber of the housing through the end wall of the housing, the working section of the key being held by a cam wedge which is actuated to bear against the said key by a slidable member which moves longitudinally in the housing in response to a master key being inserted into and rotated at a lock at the opposed end of the housing. Rotation of the master key in the opposite direction, displaces the slide member in the opposite direction to release the cam wedge and the retained key.

In a preferred embodiment a spring cam is employed to hold the cam wedge in place to securely hold the key until the slide is released by the master key. The master key lock assembly is simple in construction, strong and efficient in use and yet can be operated only by a key having the proper longitudinal grooves to be received by a uniquely grooved key plate. The present invention is thus distinguished from the inventions disclosed and claimed in my prior applications in that the mechanism for securely holding the key in place is simpler, and more economical to manufacture because it requires a minimum of parts, and the master key is less subject to duplication by unauthorized personnel.

BRIEF DESCRIPTION OF THE DRAWING

The invention will be described in greater detail with reference to the accompanying drawing in which the same parts have the same reference numerals and:

FIG. 3 is a sectional view of the device for engaging and releasably securing the working section of the key with the key released, the view being taken along the lines 3—3 of FIG. 1;

FIG. 4 is a sectional view of the device shown in FIG. 3 with the key securely held therein.

DESCRIPTION OF PREFERRED EMBODIMENTS

Figures 1, 2:
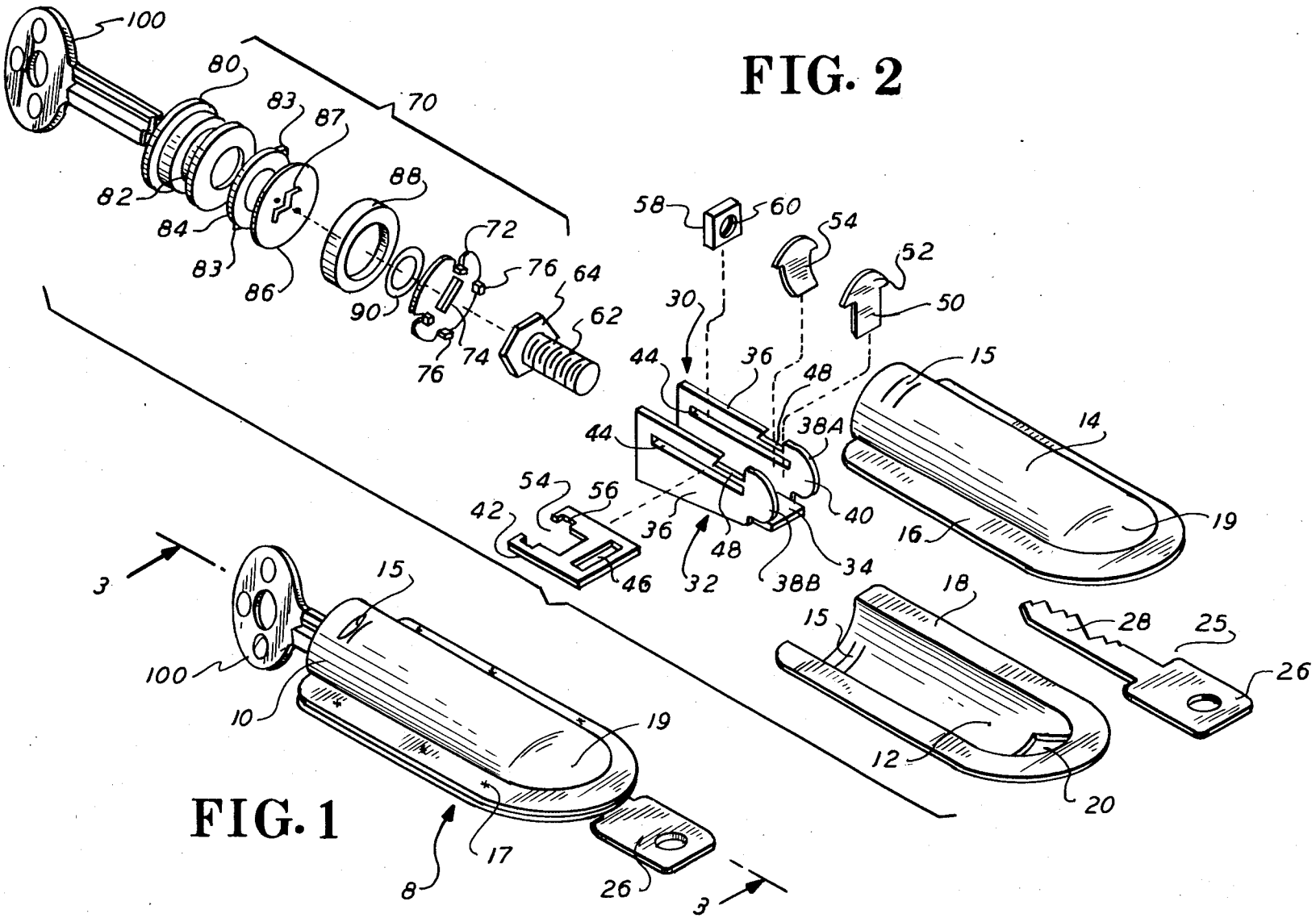
FIG. 1 is an assembly drawing of a key retaining device according to the invention shown in perspective.
FIG. 2 is an exploded view in perspective of the key retaining device shown in FIG. 1.

Referring to the drawings, and in particular, FIGS. 1 and 2, the key retaining device 8 shown, comprises two generally semicylindrical shells 12, 14, each of which has a flange 16, 18. These flanges may be secured together by welding (as at 17) bolts or the like to form a housing 10 for the key retaining device, one end of which is closed by a hemispherical end-wall 19 having an opening 20 for receiving a key 25, such as for example, an automobile key, having a handle section 26 and a working or profiled section 28.

A key retaining mechanism 30 fits into the housing 10 as shown in FIG. 2. This key retaining mechanism 30 includes generally U-shaped member 32 which comprises a base 34 and walls 36 forming a channel 40. The U-shaped member 32 has rounded ends 38A and 38B and the base 34 of the channel 40 slopes upwardly to fit into the shells 12, 14. A sliding member 42 fits into longitudinal slots 44 in the walls 36. Sliding member 42 has a transverse slot 46 which, in cooperation with an upper transverse slot 48 in the walls 36 receives a cam wedge 50, the head 52 of which fits into slot 48.

Sliding member 42 has an aperture 54 which opens into a transverse slot 56, spaced from slot 46, for receiving a nut 58 having threads 60, into which bolt 62 fits and engages the threads 60 of nut 58. Nut 58 snugly fits in slot 56. Bolt 62 is coupled to a master key lock assembly 70 by engagement of an inner key hole plate 72 with the head 64 of bolt 62 by two pairs of protrusions 76. Key hole plate 72 has a slot 74 into which fits the generally flat end of a master key 100.

In an alternate embodiment, bolt head 64 can be provided with a rectangular slot into which the flat end of a master key can be inserted and inner key hole plate 72 is eliminated. In this embodiment, master key lock assembly 70 is coupled to bolt 62 solely by the insertion of a key into the master key lock assembly 70.

The master lock assembly 70 is held in the cylindrical end of the housing 10 opposite the hemispherical end wall 19, when the semicylindrical shells 12, 14 are secured together to form the key retaining device 8 as illustrated in FIGS. 3 and 4. The master lock assembly 70 is retained within housing 10 by an outer bushing 80 which serves as the end plate for the key retaining device 8. Slot 82 in the periphery of the bushing 80 serves as a track within which inwardly projecting notches 15 in the shells 12, 14 engage and retain the outer bushing 80, serving both as a means for restraining the assembly within the end of the housing as well as preventing the rotation thereof when a key 100 is turned.

The master key lock assembly 70 includes the bushing 80, locking washer 84, key plate 86, inner bushing 88, "O" ring 90, and inner key hole plate 72.

As shown, bushing 80 retains the master key lock assembly 70 within the housing 10 by virtue of inwardly projecting notches 15 in shells 12, 14 being keyed into slot 82 of end bushing 80. Projections 83 on opposite sides of locking washer 84, engage in groove 13, formed by the inner walls of casing 12, 14 where flanges 16, 18 meet, to prevent the washer 84 from rotating. Key plate 86, which is provided with a tortuous grooved slot 87 configured to receive a key with properly formed longitudinal grooves, is mounted between locking washer 84 and inner bushing 88. An "O" ring 90 is recessed within the internal diameter of inner bushing 88 adjacent key hole plate 72 which is coupled with bolt 62.

Referring now to FIGS. 3 and 4, insertion of a master key 100 into lock 70 through key plate 86, bushing 88 and "O" ring 90, provides for the engagement of the end of master key 100 into slot 74 of key hole plate 72. The "O" ring 90 snugly engages the edges of the key 100 and retains it in engagement with key hole plate 72. Rotation of master key 100 in lock 70 rotates the key hole plate 72 and, thereby, bolt 62. Bolt 62 is consequently threaded out of (or into) nut 58. (Nut 58 preferably carries left hand threads so that it "moves away" from bolt 62 as the latter is turned in a clockwise direction.) This causes slide member 42 to move longitudinally (to the right in the drawing) within U-shaped member 32. In doing so, cam wedge 50 is tilted to a more vertical orientation (i.e. wedge 50 is rotated counterclockwise in the sense of FIGS. 3 and 4), as the bolt 62 is threaded out of the nut 58, whereby the bottom beveled edge 51 of the member 50 engages a profiled section of a key, and the upper edge 52 of member 50 abuts the interior of the housing 10 to effect a firm wedging action. Conversely, if the key 100 is rotated counterclockwise to thread the bolt 62 into the nut 58, the slide 42 moves toward the left, tilting the wedge-like member 50 away from the profiled section of a key.

In order to more firmly secure the key when the wedge-like member 50 is moved to the right, as in FIG. 4, spring 54, which is thinner than cam wedge 50 and is bent slightly to the right (i.e., with its concave face in contact with wedge member 50), fits into slots 46 and 48 behind cam wedge 50 as an additional cam wedge. This element 54 acts as a spring, urging cam wedge 50 against the profiled portion of a key inserted into the key-retaining device 8 when the slide 42 is moved to the right with respect to the U-shaped member 34.

DESCRIPTION OF OPERATION

Reference may be had to FIGS. 1 through 4 in connection with this description of the operation of the present device. Thus, in operation, key 25 is inserted through the open end 20 of housing 10 into U-shaped channel member 34, as far as possible. Master key 100 is inserted into lock 70, through tortuous grooved slot 87 in key plate 86 to engage with slot 74 in inner key hole plate 72, and rotated to partially unthread bolt 62 from nut 58. This causes slide member 42 to move to the right (in the sense of the drawings) causing cam wedge 50 to rotate counterclockwise so that its beveled bottom edge 51 moves downwardly and engages the profiled section 28 of the key, while the upper edge 52 of member 50 abuts the interior of housing 10 to effect a firm wedging action. Key 100 can now be withdrawn from lock assembly 70. Key 25 is now securely held in the U-shaped channel member by cam wedge 50.

To release key 25, master key 100 must be inserted in lock assembly 70 and rotated to turn bolt 62 and thread it into nut 58. This causes slide 42 to move to the left, causing a clockwise rotation of cam wedge 50, thereby moving its upper edge 52 from the wall of housing 10 and lifting its engaging beveled bottom edge 51 from key 25, whereby key 25 can be readily withdrawn.

Having thus described the invention with reference to a specific emodiment, other modifications will be apparent to those skilled in the art without departing from the scope of the invention which is defined in the following claims.

What is claimed is:

1. A key retaining device for capturing and selectively locking therein a portion of the working section of a key having a working section and a handle section, said device comprising:

housing means forming a chamber therein, a slot disposed through an end of said housing means, said slot being in communication with said chamber and dimensioned to accommodate therethrough a portion of said working section of said key for axial insertion into said chamber;

means for selectively securing said working section of said key, including rotatable means to actuate a clamping member to releasably engage and secure said working section of said key within said chamber; and selective locking means comprising a master key lock assembly mounted in the opposite end of said housing means adapted to receive therein a master key for actuation of said selective securing means by insertion of said master key into said lock assembly to rotate said rotatable means to actuate said clamping member to releasably engage and secure the working section of a key inserted into said chamber.

2. A key retaining device as claimed in claim 1 wherein said selective securing means includes means to slidably actuate a clamping member to releasably engage the working section of a key.

3. A key retaining device as claimed in claim 2 wherein said master key lock assembly comprises means for selectively rotating a master key in said lock assembly when said selective securing means is to be actuated.

4. A key retaining device as claimed in claim 3 wherein rotation of said master key in one direction actuates said selective securing means to engage and secure the working section of said key, and rotation of said master key in the opposite direction actuates said selective securing means to open said engaging means.

5. A key retaining device as claimed in claim 2 wherein said selective securing means includes a cam wedge.

6. A key retaining device as claimed in claim 5 wherein said selective securing means includes a freely-rotatable bolt member rotatable when said master key is inserted into said lock assembly, and further includes a nut in which said bolt is inserted.

7. A key retaining device as claimed in claim 1 which includes a key plate having a tortuous grooved slot configured to receive a key with properly formed longitudinal grooves.

8. A key retaining device as claimed in claim 7 wherein said selective securing means is actuated by insertion of the end of the master key in said lock into engagement with said means to actuate said clamping member in said selective securing means.

9. A key retaining device comprising:

(a) a housing forming a chamber therein which is open at one end to receive a key having a working section which remains in said housing and a handle section;

(b) a channeled member having a transverse slot, said channeled member receiving the working section of the key axially within the housing;

(c) a member slideable within the channeled member, said slideable member having a transverse slot therein;

(d) a wedge member in the transverse slot of the channeled member having a beveled edge portion extending into the transverse slot of said slideable member;

(e) a nut member inserted into said slideable member;

(f) a freely-rotatable bolt member insertable into said nut member for moving said slideable member upon threading in said nut thereby moving said wedge member to secure and release a key in said channeled member; and (g) locking means separate from said bolt member closing the other end of said housing for receiving a master key therein for threading and unthreading the bolt member in said nut member thereby locking and unlocking said first-named key, said locking means permitting said bolt member to be rotated only by the free end of said master key when said master key is inserted into said locking means.

* * * * *